US006063507A

United States Patent [19]

Blümel et al.

[11] Patent Number: 6,063,507

[45] Date of Patent: May 16, 2000

[54] DOUBLE-LAYERED SHEET METAL; PROCESS FOR ITS PRODUCTION AND USE OF SUCH DOUBLE-LAYERED SHEET METAL

[75] Inventors: Klaus Blümel, Dinslaken; Friedrich Behr, Krefeld; Klaus Göhler, Duisburg; Christian Häger, Ahaus; Uwe Kneiphoff, Dinslaken, all of Germany

[73] Assignee: Thyssen Stahl AG, Duisburg, Germany

[21] Appl. No.: 09/134,784

[22] Filed: Aug. 14, 1998

[30] Foreign Application Priority Data

Aug. 15, 1997 [DE] Germany ..... 197 35 421

[51] Int. Cl.[7] ..... B21D 47/04; E04C 2/32; E04C 2/34; F16S 1/00

[52] U.S. Cl. ..... 428/594; 52/783.11; 52/793.1; 52/794.1; 219/91.21; 219/91.23; 228/173.6; 228/185

[58] Field of Search ..... 428/593, 594, 428/76; 219/91.2, 91.21, 91.23; 52/783.11, 793.1, 794.1, 789.1; 228/173.6, 185

[56] References Cited

U.S. PATENT DOCUMENTS 5,228,252 7/1993 Nehls .
5,390,467 2/1995 Shuert .
5,444,959 8/1995 Tesch .

FOREIGN PATENT DOCUMENTS 1006845 1/1994 Belgium .
0 657 310 A1 6/1995 European Pat. Off. .
07 300 685 11/1995 Japan .
367 766 2/1932 United Kingdom .
WO 96/23621 8/1996 WIPO .

*Primary Examiner*—Deborah Jones
*Assistant Examiner*—Jason Savage
*Attorney, Agent, or Firm*—Proskauer Rose LLP

[57] ABSTRACT

The invention relates to a double-layered sheet metal with a first layer (5) of sheet metal comprising indented knobs ($4_I$–$4_{IV}$; $4_V$–$4_{VII}$; $4_{VIII}$–$4_{XIII}$), with several of these knobs forming the corner points of a geometrical segment ($8_I$, $8_{II}$, $8_{III}$) of the first layer (5) of sheet metal, with a second layer (6) of sheet metal which is connected to the first layer (5) of sheet metal in the area of the tips **(4*a*) of the knobs ($4_I$–$4_{IV}$; $4_V$–$4_{VII}$; $4_{VIII}$–$4_{XIII}$), and with a filling (7) made of filling material arranged in the void remaining between the layers (5, 6) of sheet metal. With such a double-layered sheet metal the danger of "total failure" in the case of a load exceeding elastically endured deformation is reduced in that the geometrical segment ($8_I$, $8_{II}$, $8_{III}$) comprises at least one indentation (10) by means of which any deformation of the double-layered sheet metal caused by a bending load is directed towards the filling (7)** in the void. Furthermore, the invention relates to a method for producing such a double-layered sheet metal.

28 Claims, 4 Drawing Sheets

Figure 1:
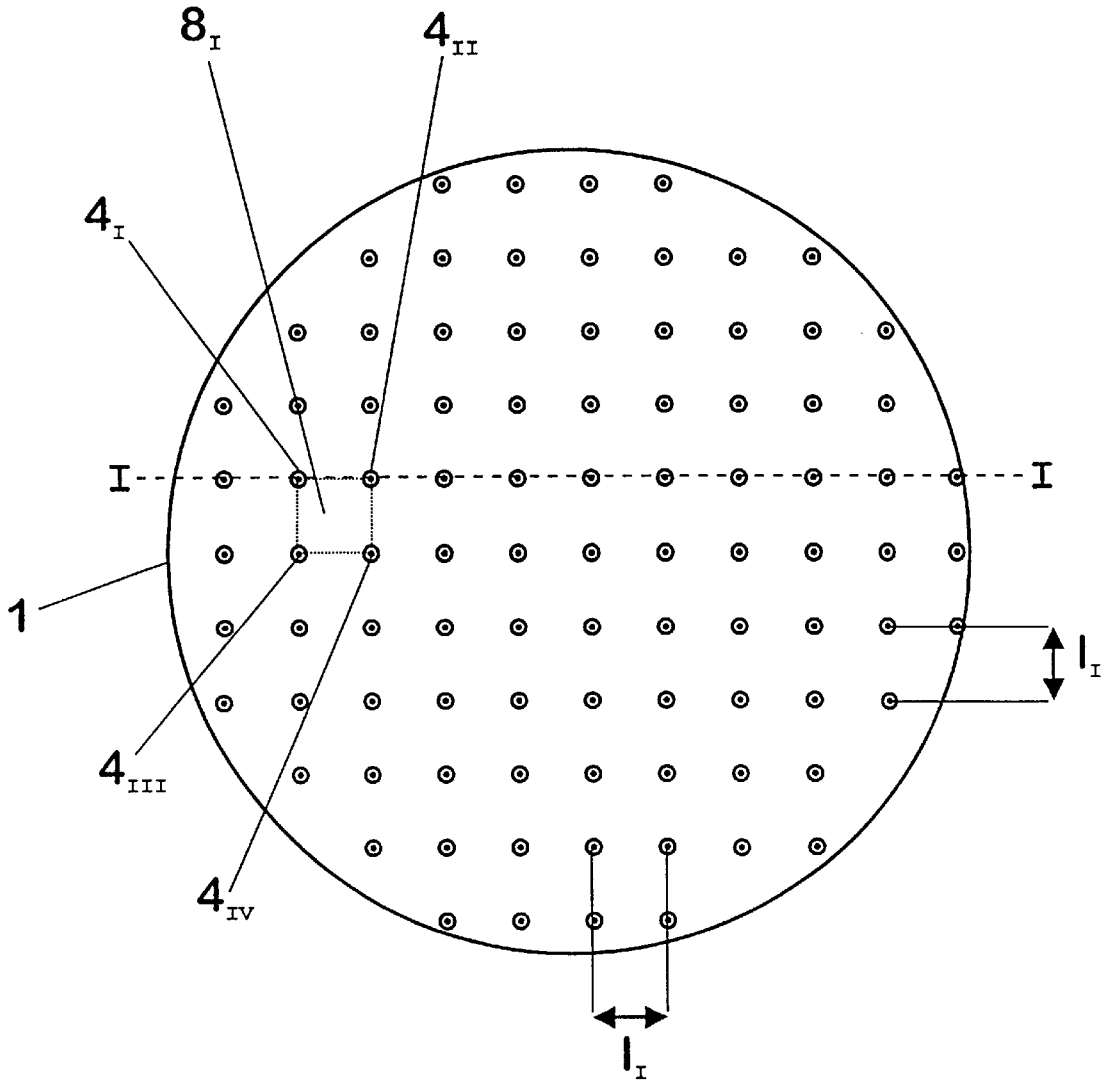

DOUBLE-LAYERED SHEET METAL; PROCESS FOR ITS PRODUCTION AND USE OF SUCH DOUBLE-LAYERED SHEET METAL

The invention relates to a double-layered sheet metal with a first layer of sheet metal comprising shaped knobs, with several of these knobs forming the corner points of at least one geometrical segment of the first layer of sheet metal, with a second layer of sheet metal which is connected to the first layer of sheet metal in the area of the base of the knobs, and with a filling made of filling material arranged in the void between the layers of sheet metal. In addition, the invention relates to a process for producing such a double-layered sheet metal and its use. Components made from double-layered sheet metals of this type can for example be used as highly stressable elements in the construction of motor vehicles.

The German patent specification DE 195 03 166 A1 discloses a double-layered sheet metal of the type described above which can be coiled and to a limited extent can be deep-drawn, as well as a method for its production. In the case of the known double-layered sheet metal, the knobs are arranged spaced apart from each other by a certain distance. This spacing is selected in such a way that the ratio between burl spacing and the length which is to be covered by a sheet metal component made from the double-layered sheet metal is larger than the ratio, multiplied by a constant, of the thickness of one of the layers of sheet metal and the distance between the neutral fibre and the geometrical centre of gravity of a chord. Components made from double-layered sheet metal designed in such a way are intended for use in framework constructions where they are subjected to transverse strain acting in the plane of the sheet metal.

While in practical application the known sheet metal panels have proven to be serviceable, their production has turned out to be difficult. In addition it has been found that where components made from sheet metal made in such a way are subjected to excessive bending loads, sudden yield to buckling can occur in the geometrical segments delimited by the knobs. In such a condition the respective component is plastically deformed in such a way that it loses its rigidity and as such becomes unserviceable. The yield to buckling of the double-layered sheet metal in the area of the geometrical segments is therefore also referred to as "total failure".

According to "Dubbels Taschenbuch für den Maschinenbau" [paperback for machine construction] 17th ed., Springer Verlag (1990) p. C38ff, in the case of a sheet steel component made from solid material, which at its geometrical centre is loaded with a force perpendicular to the sheet metal plane, it is also in the region of this geometrical centre that the highest stresses occur. It has however been shown that the equations shown in the technical book for the design of a sheet metal component experiencing bending loads are not suitable for designing a component made from double-layered sheet metal of comparable dimensions, if "total failure" of the latter is to be avoided even when subjected to a limited overload where plastic deformation already occurs.

A further significant disadvantage of known double-layered sheet metals is that none of the known double-layered sheet metal panels is able to be coiled and at the same time is able to be deep-drawn while to a large extent maintaining the spacing of the metal layers over its entire surface. Thus when deep-drawing the sheet metal known from DE 195 03 166 C2, it has for example been found that the knobs determining the spacing of the layers of sheet metal are pushed together where small radii of curvature occur.

It is the object of the invention, based on the state of the art mentioned in the introduction, to create a double-layered sheet metal where the danger of "total failure" is reduced even in the case of a load exceeding elastically endured deformation. Furthermore, a method for producing such a double-layered sheet metal is to be described.

In regard to the double-layered sheet metal, this object is met in that the geometrical segment comprises at least one indentation by means of which any deformation of the double-layered sheet metal caused by a bending load is directed towards the filling.

The invention is based on the recognition that "total failure" of the pressure-loaded position of the double-layered sheet metal is caused by the yield to buckling due to the compressive strains. By the double-layered sheet metal according to the invention, in the region of the geometrical segments, being shaped in such a way that the deformations associated with these loads are directed in a particular direction, namely the direction of the filling, a sudden yield to buckling, outward or inward, of the position of the double-layered sheet metal exposed to compressive stress is avoided. During deformation of the regions of the respective layer of sheet metal exposed to compressive stress, the filling forms a pad by which the deformed regions are supported. Consequently, in a component made from a double-layered sheet metal according to the invention, "total failure" as a result of plastic buckling only occurs at loads so high that buckling always takes place after plastic deformation which does not yet lead to "total failure". In this way the ability of the double-layered sheet metal according to the invention, to be able to withstand without basic loss of function a high load resulting in plastic deformation, is significantly increased when compared to conventional sheet metals.

In addition, in the case of a bending load, the direction of deformation towards the filling and the support pad provided to the deformed regions by the filling also makes it possible to design larger burl spacing than is the case with conventional double-layered sheet metal. This is advantageous in particular where the layers of sheet metal in the region of the burl tips are welded together since welding together of the layers of sheet metal is the costliest process step in the production of double-layered sheet metals designed in such a way. The large spacing of knobs which is possible with double-layered sheet metals according to the invention provides a further advantage of reducing the material used in the production of the knobs of the first layer of sheet metal. In this way a non-stamped portion of the layers of sheet metal remains which is optimal in size and which results in a high geometrical moment of inertia of the double-layered sheet metal according to the invention.

A preferred embodiment of the invention is characterised in that the layer of sheet metal forming the compression chord, which layer experiences compressive strain when the double-layered sheet metal is subjected to bending load, comprises indentations. Tests have shown that allocation of such indentations in the layer experiencing compressive strain under bending loads leads to significant improvement in rigidity.

With the double-layered sheet metal according to the invention, the percentage of the surface in which the first layer of sheet metal is connected with the second layer of sheet metal should preferably be between 1.4% and 2.2% of the entire surface of the double-layered sheet metal.

As mentioned above, the function of indentation in the region of the geometrical segments consists of directing deformation in case of load in a particular direction. In this, the indentations of the individual geometrical segments are configured so as to verge into each other in smooth transition. This configuration ensures that the deforming regions of the respective geometric segments move from those sections experiencing the highest strain in the case of compressive stress, in the direction of the filling.

For this purpose an embodiment of the double-layered sheet metal according to the invention is particularly suitable, in which the geometrical segment comprises a concave surface curvature. Such indentation can be created without any undue expenditure during production of the knobs in the first layer of sheet metal. Preferably the indentation in respect of the non-indented part of the geometrical segment should comprise a depth which at the most is equal to the thickness of the first layer of sheet metal. It is particularly advantageous if the depth of the indentation is ⅓ to ½ of the thickness of the first layer of sheet metal, because in this way the highest possible geometrical moment of inertia is maintained.

A further advantageous embodiment of the invention is characterised in that the thickness of the first layer of sheet metal exceeds the thickness of the second layer of sheet metal. Layers of sheet metal dimensioned in such a way provide a double-layered sheet metal with optimal rigidity. This is achieved in particular if the ratio of thickness of the first layer of sheet metal to the thickness of the second layer of sheet metal is within a range of 1.1 to 1.6. Example calculations and practical experiments have shown that elastic rigidity in a double-layered sheet metal according to the invention configured in such a way is up to 20% improved when compared with a double-layered sheet metal where the thickness of the first and second layers of sheet metal is the same.

In the case of double-layered sheet metals configured according to the invention, the spacing between the knobs and consequently the spacing between the welding spots for the layer of sheet metal comprising knobs can be determined according to the following equation:

$$l \leq 2 * \sqrt{\frac{E}{R_{P0.2}}} * S_D + D_N$$

where l=Spacing of the knobs, measured from the centre of the base of the burl;

E=Modulus of elasticity of the sheet metal material;

$R_{P\ 0.2}$=0.2% apparent yielding point (apparent limit of elasticity);

$S_D$=Thickness of the first layer of sheet metal forming the compression chord $D_N$=Diameter of a burl, measured in the area of the transition between geometrical segment and burl.

Advantageously, for a non-burled layer of sheet metal, the spacing of the welding spots is calculated according to the following equation:

$$l \leq 2 * \sqrt{\frac{E}{R_{p0.2}}} * S_Z + D_P$$

where l=Spacing of the knobs, measured from the centre of the base of the burl;

E=Modulus of elasticity of the sheet metal material;

$R_{P\ 0.2}$=0.2% apparent yielding point (apparent limit of elasticity);

$S_Z$=Thickness of the layer of sheet metal which does not comprise any knobs $D_P$=Diameter of a welding spot.

If the layers of sheet metal of the double-layered sheet metal according to the invention are spot welded and if the second layer of sheet metal is free of knobs and smooth, the minimum diameter $D_P$ with regard to optimal rigidity can be determined according to the following equation:

$$D_P = 2 * \sqrt{\frac{S_g * 1}{\Pi} + \frac{S_g^2}{\Pi^2}} - \frac{2S_g}{\Pi}$$

where l=Spacing of the knobs, measured from the centre of the base of the burl;

$S_g$=Thickness of the layer of sheet metal which does not comprise any knobs;

$D_P$=Diameter of welding spots.

It is also favourable if the diameter of the welding spots is smaller than the diameter of the base of the knobs. If the welding spots and knobs are made in such a way, it is ensured that peaks of strain occurring in the vicinity of the welding spot are safely withstood. This is the case in particular if the diameter of the base of the knobs is 1.5 times to twice the diameter of the welding spots.

A further advantageous embodiment of the invention is characterised in that the border area of the double-layered sheet metal comprises reinforcements. These can be formed by beading its margins. Alternatively or as a supplement, the reinforcement can be welded on and/or formed by a bead all around.

Depending on the material properties required and the visual appearance of the components made from the double-layered sheet metal it is advantageous, as mentioned, if one of the layers of sheet metal is smooth. If a double-layered sheet metal is required which is particularly rigid against buckling or warping, then this requirement can be met in that with the double-layered sheet metal according to the invention the second layer of sheet metal comprises knobs corresponding to those of the first layer of sheet metal, that the tips of the knobs of the two layers of sheet metal are aligned so as to contact each other and that the two layers of sheet metal are connected to each other by means of welding together the contacting tips of the knobs. In this case either both of the layers of sheet metal or one layer only comprise indentations in the geometrical segments.

In regard to the method of producing a double-layered sheet metal according to the invention, the above-mentioned object is met in that knobs are stretch-formed on a sheet metal panel forming the first layer of sheet metal, using a holding-down force and using an upper die and a die-plate of a diameter exceeding that of the upper die;

the filling is placed onto the first panel of sheet metal comprising knobs, that a sheet metal panel forming the second layer of sheet metal is placed onto the knobs of the first panel of sheet metal; and the first layer of sheet metal and the second layer of sheet metal are connected in the region of the contact surfaces between the knobs of the first layer of sheet metal and the second layer of sheet metal.

When stretch-forming the knobs by means of an upper die and an oversized die-plate during which the sheet metal is held down on the side of the upper die, the desired indentations pointing in the direction of the filling are made automatically in the region of the geometrical segments delimited by the knobs. In this way a double-layered sheet metal according to the invention can be produced economically and with little effort. The formation of indentations can be enhanced in that the holding-down device comprises convex surface curvatures corresponding to the shape of the indentations to be made.

Preferably, welding should be carried out as spot-resistance welding. Advantageously the filling is bonded to one layer or, preferably, to both layers of sheet metal.

A double-layered sheet metal according to the invention, where both layers of sheet metal comprise knobs can be produced in that knobs and concave surface curvatures are indented into the second sheet metal panel in the same way as into the first sheet metal panel; that the panels of sheet metal are placed one on top of the other in such a way that the tips of the knobs of the one panel rest against the tips of the other panel; and that welding is carried out in the region of the base of the knobs.

To obtain a particularly rigidly designed construction made of a component made from the double-layered sheet metal according to the invention, the double-layered sheet metal should be formed in one deep-drawing operation in the direction of the deflexion expected under load. The greatest rigidity is attained if the deep-drawing die used for deep-drawing is in the shape of the envelopes of the elastic line which results from the force with a predefined load individually at each position of the plate. An upper die meeting these requirements can for example comprise the shape of a dish, resulting in the shaped double-layered sheet metal being trough-shaped with a cross-section in the shape of an elongated bisected ellipse.

The use of double-layered sheet metal panels according to the invention is particularly advantageous in the production of components in motor vehicle construction, for example as supporting plates. This applies in particular to those components which due to their load experience deflection. The floor of the boot of a passenger motor vehicle or the floor of a bus are examples of such components.

Figure 2:
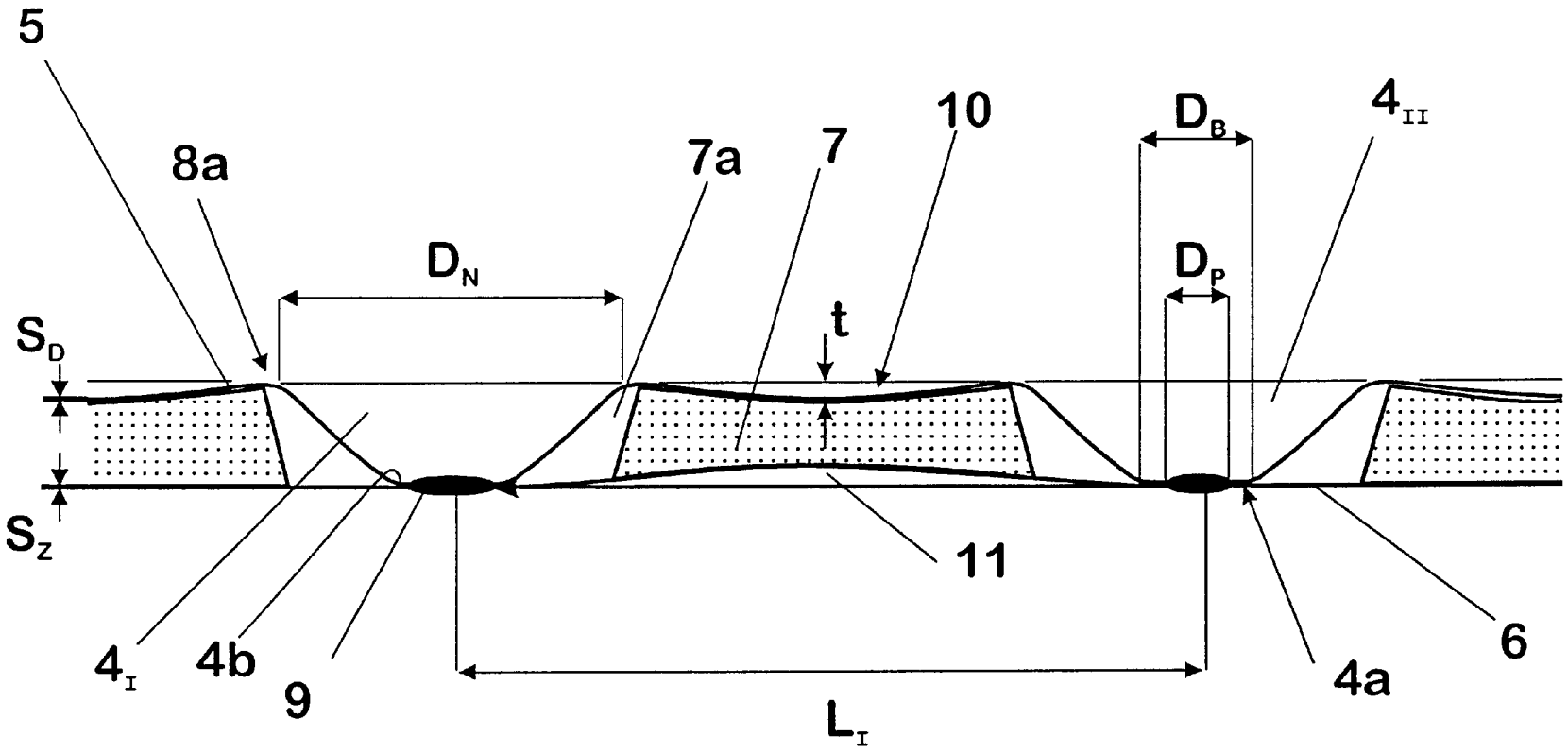
Figure 3:
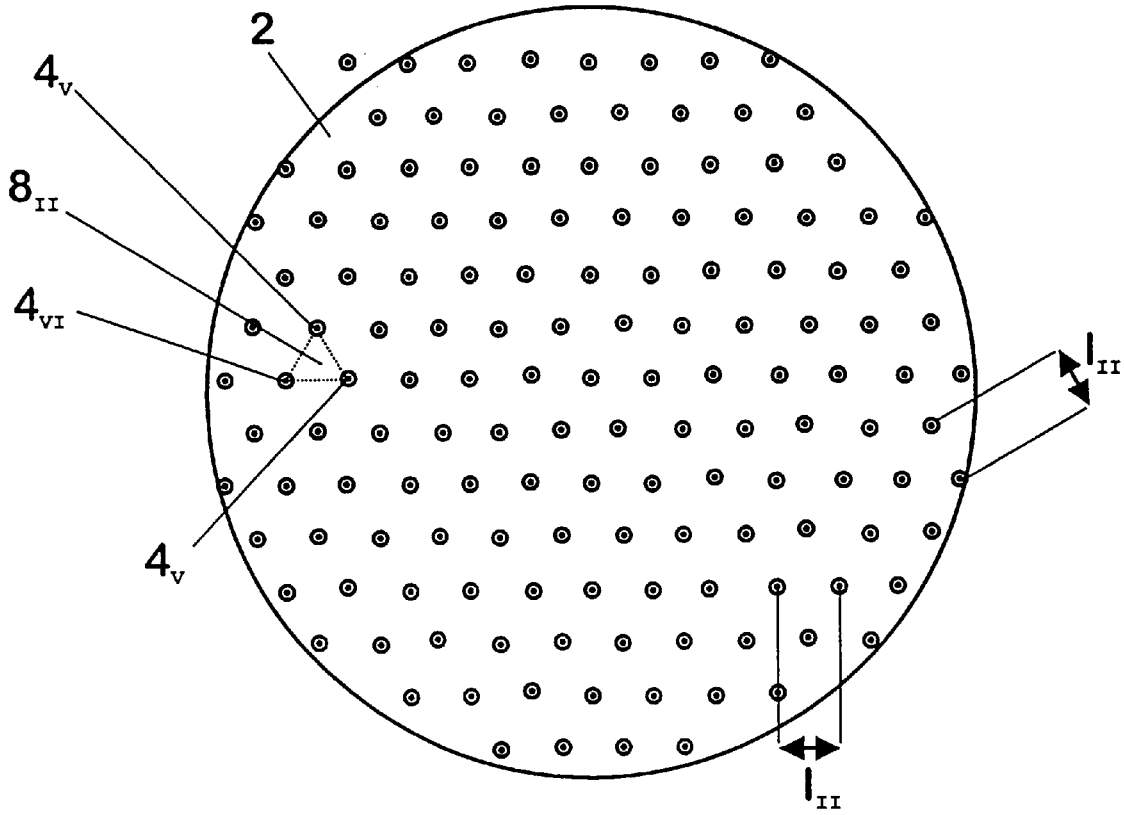
Figure 4:
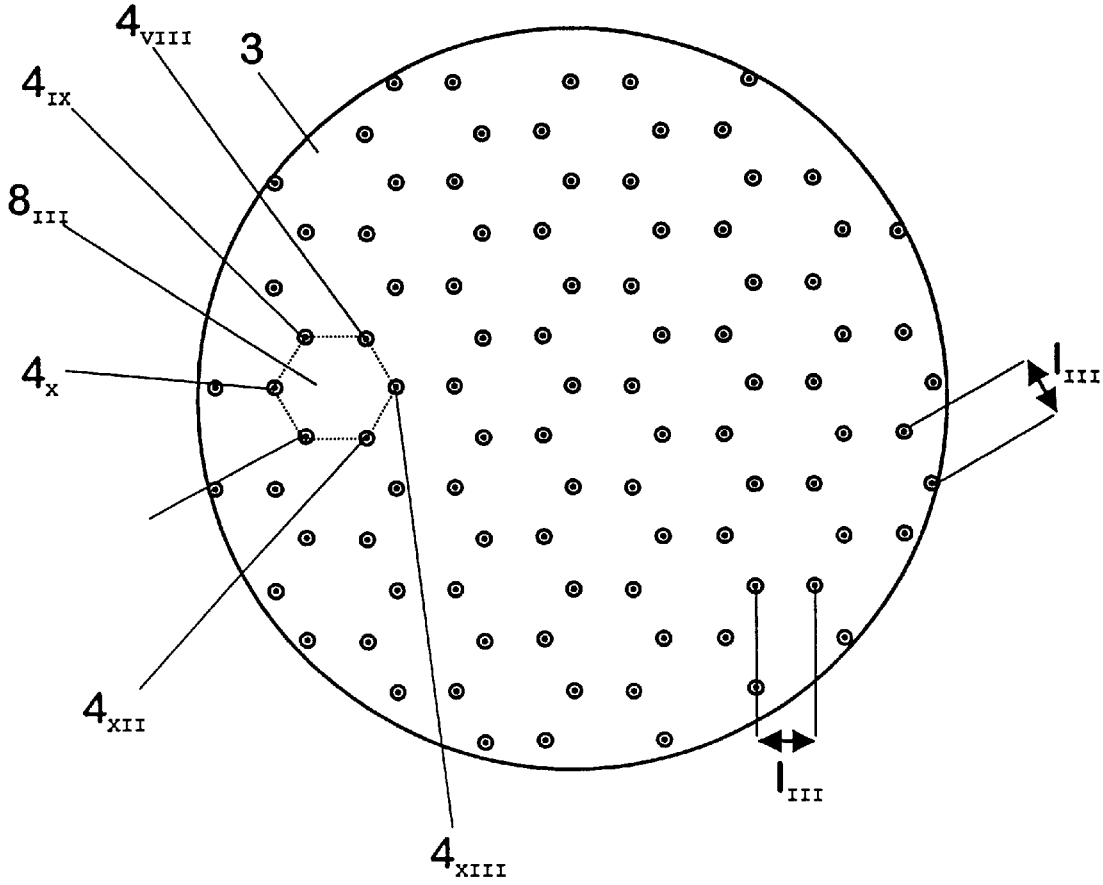

Below, the invention is explained in more detail by means of a drawing showing embodiments. The following are shown diagrammatically:

FIG. 1 a supporting plate made from double-layered sheet metal, in top view;

FIG. 2 a section of the supporting plate according to FIG. 1 in a section along the line I—I of FIG. 1;

FIG. 3 another supporting plate made from double-layered sheet metal, in sectional top view;

FIG. 4 a further supporting plate made from double-layered sheet metal, in sectional top view.

LIST OF REFERENCE CHARACTERS

1, 2, 3 Plates
$\mathbf{4}_I$–$\mathbf{4}_{XIII}$ Knobs
4*a* Tips of the knobs $\mathbf{4}_I$–$\mathbf{4}_{XIII}$
5 Layer of sheet metal
6 Layer of sheet metal
7 Filling
$\mathbf{8}_I$, $\mathbf{8}_{II}$, $\mathbf{8}_{III}$ Geometrical segments
8*a* Transition from the respective geometrical segment $\mathbf{8}_I$–$\mathbf{8}_{III}$ to a burl $\mathbf{4}_I$–$\mathbf{4}_{XIII}$
9 Welding spots
10 Indentations
$D_B$ Diameter of the base 4*b* of the knobs $\mathbf{4}_I$–$\mathbf{4}_{XIII}$
$D_N$ Diameter of a burl $\mathbf{4}_I$–$\mathbf{4}_{XIII}$, measured in the region 8*a* of the transition from the respective geometrical segment $\mathbf{8}_I$–$\mathbf{8}_{III}$, to a burl $\mathbf{4}_I$–$\mathbf{4}_{XIII}$
$D_P$ Diameter of the welding spots 9
E Modulus of elasticity
$l_I$, $l_{II}$, $l_{III}$ Spacing of the knobs $\mathbf{4}_I$–$\mathbf{4}_{XIII}$
$R_{p\ 0.2}$ 0.2% apparent yielding point
$S_D$ Thickness of the first layer 5 of sheet metal
$S_Z$ Thickness of the second layer 6 of sheet metal
t Depth of the indentations 10

The plates 1, 2, 3 shown in FIGS. 1 to 4 are made from a double-layered sheet metal. They incorporate a first layer 5 of sheet metal comprising cup-shaped knobs $\mathbf{4}_I$–$\mathbf{4}_{IV}$, $\mathbf{4}_V$–$\mathbf{4}_{VII}$ or $\mathbf{4}_{VII}$–$\mathbf{4}_{XIII}$, and a smooth second layer 6 of sheet metal touching the tips 4*a* of the knobs $\mathbf{4}_I$–$\mathbf{4}_{VII}$. The thickness $S_D$ of the first layer 5 of sheet metal is 1.1 to 1.6 times larger than the thickness $S_Z$ of the second layer 6 of sheet metal. Both layers 5, 6 of sheet metal are made from steel sheeting galvanised on both sides.

Between the layers 5, 6 of sheet metal there is a filling 7 made of a layer of perforated cotton paper. The knobs $\mathbf{4}_I$–$\mathbf{4}_{XIII}$ extend through the perforations of the filling 7.

In the embodiment shown in FIGS. 1 and 2, four knobs $\mathbf{4}_I$–$\mathbf{4}_{IV}$ with the same spacing $l_I$ from each other, form the corners of a square geometric segment $\mathbf{8}_I$. In the embodiment according to FIG. 3, three knobs $\mathbf{4}_V$–$\mathbf{4}_{VII}$ with the same spacing $l_{II}$ from each other interact to form a geometrical segment $\mathbf{8}_{II}$ in the shape of an equilateral triangle. In the embodiment according to FIG. 4, a hexagonal geometrical segment $\mathbf{8}_{III}$ is delimited by six knobs $\mathbf{4}_{VIII}$–$\mathbf{4}_{XIII}$ with the same spacing $l_{III}$ from each other.

In each of the embodiments, the spacing 1 of the knobs $\mathbf{4}_I$–$\mathbf{4}_{XIII}$ measured from the centre of the base 4*b* is determined according to the equation:

$$l \leq 2 * \sqrt{\frac{E}{R_{P0.2}}} * S_D + D_N$$

where E denotes the modulus of elasticity of the sheet metal material; $R_{p\ 0.2}$ the 0.2% apparent yielding point (apparent limit of elasticity) of the sheet metal material; $S_D$ the thickness of the first layer 5 of sheet metal forming the compression chord; and $D_N$ the diameter of a burl $\mathbf{4}_I$–$\mathbf{4}_{XIII}$, measured in the region 8*a* of the transition from the respective geometrical segment $\mathbf{8}_I$–$\mathbf{8}_{III}$ to a burl $\mathbf{4}_I$–$\mathbf{4}_{XIII}$.

The layers 5, 6 of sheet metal are connected to each other by means of welding spots 9, with the diameter $D_P$ of the welding spots 9 being smaller than the diameter $D_B$ of the base 4*b* of the knobs $\mathbf{4}_I$–$\mathbf{4}_{XIII}$.

In the region of the geometrical segments $\mathbf{8}_I$–$\mathbf{8}_{III}$ an indentation 10 is shaped into the upper layer of sheet metal 5 comprising the knobs $\mathbf{4}_I$–$\mathbf{4}_{XIII}$. The respective indentations 10 are shaped as concave surface curvatures extending from the transitional region 8*a* to the respective knobs $\mathbf{4}_I$–$\mathbf{4}_{XIII}$ adjoining the geometrical segments $\mathbf{8}_I$–$\mathbf{8}_{III}$. In this, the depth t of the indentations 10 in relation to the non-shaped section of the geometrical segments $\mathbf{8}_I$–$\mathbf{8}_{III}$ corresponds to about half the thickness $S_D$ of the first layer 5 of sheet metal.

The smooth second layer 6 of sheet metal comprises comparable indentations 11. They extend in the geometrical segments delimited by the welding spots 9.

To produce the double-layered sheet metal for manufacturing the plate 1 shown in FIGS. 1 to 4, first tapered knobs $\mathbf{4}_I$–$\mathbf{4}_{XIII}$ are indented in the layer of sheet metal 5 by stretch deep-drawing. For this purpose an upper die (not shown) and a die-plate (also not shown) are used, with the diameter of the die-plate aperture being larger than, for example twice as large as, the diameter of the upper die.

During forming, a holding-down force is exerted on the first layer 5 of sheet metal by a holding-down device (not shown). At its surface facing the layer of sheet metal, the holding-down device comprises convex surface curvatures corresponding to the indentations 10, which convex surface curvatures assist in the creation of the indentations 10.

After producing the knobs $\mathbf{4}_I$–$\mathbf{4}_{XIII}$, the filling 7 is placed onto the first layer 5 of sheet metal, with the knobs $\mathbf{4}_I$–$\mathbf{4}_{XIII}$ extending through the perforations 7*a* of the filling 7.

Then the smooth second layer 6 of sheet metal is placed onto the tips 4*a* of the knobs and connected to the first layer 5 of sheet metal in the region of the tips 4*a* of the knobs by means of spot-resistance welding.

Finally, the double-layered sheet metal comprising the two layers 5, 6 of sheet metal and the filling 7 is subjected to a deep-drawing operation during which indentations 10 also form in the geometrical segments $\mathbf{8}_I$–$\mathbf{8}_{III}$ delimited by the knobs $\mathbf{4}_I$–$\mathbf{4}_{XIII}$ of the first layer 5 of sheet metal or indentations 11 in the geometrical segments of the second layer 6 of the sheet metal delimited by the welding spots 9.

Comparison tests have shown that a plate 1, 2, 3 made from the double-layered sheet metal explained above can withstand up to 1.5 times the load that a similarly dimensioned plate made from a traditional double-layered sheet metal without indentations in the geometrical segments can withstand.

What is claimed is:

1. A double-layered sheet metal with a first layer (5) of sheet metal comprising shaped knobs ($\mathbf{4}_I$–$\mathbf{4}_{IV}$; $\mathbf{4}_V$–$\mathbf{4}_{VII}$; $\mathbf{4}_{VIII}$–$\mathbf{4}_{XIII}$), with several of these knobs forming the corner points of a geometrical segment ($\mathbf{8}_I$, $\mathbf{8}_{II}$, $\mathbf{8}_{III}$) of the first layer (5) of sheet metal, with a second layer (6) of sheet metal which is connected to the first layer (5) of sheet metal in the area of the tips (4*a*) of the knobs ($\mathbf{4}_I$–$\mathbf{4}_{IV}$; $\mathbf{4}_V$–$\mathbf{4}_{VII}$; $\mathbf{4}_{VIII}$–$\mathbf{4}_{XIII}$), and with a filling (7) made of filling material arranged in a void between the layers (5, 6) of sheet metal, wherein the geometrical segment ($\mathbf{8}_I$, $\mathbf{8}_{II}$, $\mathbf{8}_{III}$) comprises at least one indentation (10) by means of which any deformation of the double-layered sheet metal caused by a bending load is directed towards the filling (7) in the void.

2. A double-layered sheet metal according to claim 1, wherein the first and the second layers (5, 6) of sheet metal are connected to each other by spot welds.

3. A double-layered sheet metal according to claim 1 wherein the layer (5) of sheet metal forming a compression chord, which layer (5) experiences compressive strain when the double-layered sheet metal is subjected to bending load, comprises indentations (10).

4. A double-layered sheet metal according to claim 1, wherein the geometrical segment ($\mathbf{8}_I$, $\mathbf{8}_{II}$, $\mathbf{8}_{III}$) comprises a concave surface curvature.

5. A double-layered sheet metal according to claim 4, wherein the depth (t) of the concave surface curvatures in relation to a non-shaped section of the geometrical segments ($\mathbf{8}_I$, $\mathbf{8}_{II}$, $\mathbf{8}_{III}$) corresponds at the most to the thickness ($S_D$) of the first layer (5) of sheet metal.

6. A double-layered sheet metal according to claim 1, wherein the thickness ($S_D$) of the first layer (5) of sheet metal exceeds the thickness ($S_Z$) of the second layer (6) of sheet metal.

7. A double-layered sheet metal according to claim 6, wherein the ratio of thickness ($S_D$) Of the first layer (5) of sheet metal to the thickness ($S_Z$) of the second layer (6) of sheet metal is within a range of 1.1 to 1.6.

8. A double-layered sheet metal according to claim 2, wherein a spacing ($l_I$, $l_{II}$, $l_{III}$) between two welding spots (9) for the layer (5) of sheet metal comprising knobs ($\mathbf{4}_I$–$\mathbf{4}_{IV}$; $\mathbf{4}_V$–$\mathbf{4}_{VII}$; $\mathbf{4}_{VIII}$–$\mathbf{4}_{XIII}$), is determined according to the following equation:

$$l \leq 2 * \sqrt{\frac{E}{R_{P0.2}}} * S_D + D_N$$

where l=Spacing of the knobs, measured from the centre of the base of the knob;

E=Modulus of elasticity of the sheet metal material;

$R_{p\ 0.2}$=0.2% apparent yielding point (apparent limit of elasticity);

$S_D$=Thickness of the first layer of sheet metal forming the compression chord $D_N$=Diameter of a knob, measured in the area of the transition between geometrical segment and knob.

9. A double-layered sheet metal according to one of claim 2, wherein a spacing ($l_I$, $l_{II}$, $l_{III}$) between two welding spots (9) for the layer of sheet metal comprising no knobs ($\mathbf{4}_I$–$\mathbf{4}_{IV}$; $\mathbf{4}_V$–$\mathbf{4}_{VII}$; $\mathbf{4}_{VIII}$–$\mathbf{4}_{XIII}$), is determined according to the following equation:

$$l \leq 2 * \sqrt{\frac{E}{R_{p0.2}}} * S_Z + D_P$$

where l=Spacing of the knobs, measured from the centre of the base of the knob;

E=Modulus of elasticity of the sheet metal material;

$R_{p\ 0.2}$=0.2% apparent yielding point (apparent limit of elasticity);

$S_Z$=Thickness of the layer of sheet metal which does not comprise any knobs $D_P$=Diameter of a welding spot.

10. A double-layered sheet metal according to claim 2, wherein the diameter ($D_P$) of the welding spots (9) is smaller than the diameter ($D_B$) of the base (4*b*) of the knobs ($\mathbf{4}_I$–$\mathbf{4}_{IV}$; $\mathbf{4}_V$–$\mathbf{4}_{VII}$; $\mathbf{4}_{VIII}$–$\mathbf{4}_{XIII}$).

11. A double-layered sheet metal according to one of claim 2, wherein the second layer (6) of sheet metal is non-burled and the diameter ($D_P$) of the welding spots (9) corresponds to the diameter according to the following equation:

$$D_P = 2 * \sqrt{\frac{S_g * 1}{\Pi} + \frac{S_g^2}{\Pi^2}} - \frac{2S_g}{\Pi}$$

where l=Spacing of the knobs, measured from the centre of the base of the burl;

$S_g$=Thickness of the layer of second layer (6) which does not comprise any knobs $D_P$=Diameter of welding spots.

12. A double-layered sheet metal according to claim 1, wherein the percentage of the surface in which the first layer (5) of sheet metal is connected with the second layer (6) of sheet metal is between 1.4% and 2.2% of the entire surface of the double-layered sheet metal.

13. A double-layered sheet metal according to claim 12, wherein the diameter ($D_B$) of the base (4*b*) of the knobs ($\mathbf{4}_I$–$\mathbf{4}_{IV}$; $\mathbf{4}_V$–$\mathbf{4}_{VII}$; $\mathbf{4}_{VIII}$–$\mathbf{4}_{XIII}$) is 1.5 times to twice the diameter ($D_P$) of the welding spots (9).

14. A double-layered sheet metal according to claim 1, wherein the border area of the double-layered sheet metal comprises reinforcements.

15. A double-layered sheet metal according to claim 14, wherein the reinforcements are formed by beading its margins.

16. A double-layered sheet metal according to claim 14, wherein the reinforcements are formed by welding with reinforcement elements.

17. A double-layered sheet metal according to claim 14, wherein the reinforcements are formed by at least one bead all around.

18. A double-layered sheet metal according to claim 1, wherein the filling (7) is a perforated paper.

19. A double-layered sheet metal according to claim 1, wherein the filling (7) is bonded to at least one of the layers (5, 6) of sheet metal.

20. The double-layered sheet metal according to claim 1 wherein the second layer of sheet metal comprises knobs corresponding to the first layer of sheet metal, the tips of the knobs of both layers of sheet metal are aligned so as to contact each other, and the two layers of sheet metal are connected to each other by welding at the contact tips.

21. A method for producing a double-layered sheet metal according to claim 1, wherein knobs ($\mathbf{4}_{I}$–$\mathbf{4}_{IV}$; $\mathbf{4}_{V}$–$\mathbf{4}_{VII}$; $\mathbf{4}_{VIII}$–$\mathbf{4}_{XIII}$) are stretch-formed on a sheet metal panel forming the first layer (5) of sheet metal, using a holding-down force and using an upper die and a die-plate of a diameter exceeding that of the upper die;

the filling (7) is placed onto the first panel (5) of sheet metal comprising knobs ($\mathbf{4}_{I}$–$\mathbf{4}_{IV}$; $\mathbf{4}_{V}$–$\mathbf{4}_{VII}$; $\mathbf{4}_{VIII}$–$\mathbf{4}_{XIII}$);

a sheet metal panel forming the second layer (6) of sheet metal is placed onto the knobs ($\mathbf{4}_{I}$–$\mathbf{4}_{IV}$; $\mathbf{4}_{V}$–$\mathbf{4}_{VII}$; $\mathbf{4}_{VIII}$–$\mathbf{4}_{XIII}$) of the first panel (5) of sheet metal; and the first layer (5) of sheet metal and the second layer of sheet metal are connected in the region of the contact surfaces between the knobs ($\mathbf{4}_{I}$–$\mathbf{4}_{IV}$; $\mathbf{4}_{V}$–$\mathbf{4}_{VII}$; $\mathbf{4}_{VIII}$–$\mathbf{4}_{XIII}$) of the first layer (5) of sheet metal and the second layer of sheet metal.

22. A method according to claim 21, wherein welding together is carried out as spot-resistance welding.

23. The method according to claim 21 wherein the knobs are shaped into the second layer of sheet metal as well as into the first layer of sheet metal, and the layers of sheet metal are placed one on top of the other in such a way that the tips of the knobs of one layer of sheet metal rest against the tips of the knobs of the other layer of sheet metal, and that welding is carried out in the region of the base of the knobs.

24. A method according to one of claim 21, wherein the double-layered sheet metal is formed in one deep-drawing operation in the direction of the deformation expected under load of the double-layered sheet metal.

25. A method according to one of claim 21, wherein the filling (7) is bonded to at least one of the layers (5, 6) of sheet metal.

26. A method according to one of claim 21, wherein the holding-down device comprises convex surface curvatures corresponding to the shape of the indentations in the double-layered sheet metal.

27. A method of using the double-layered sheet metal according to claim 1 comprising the steps of installing the sheet metal as a supporting plate and exposing the installid sheet metal to a load.

28. The method according to claim 27, wherein the supporting plate is installed in a motor vehicle.

* * * * *